US010670007B2

(12) United States Patent
Amiot et al.

(10) Patent No.: US 10,670,007 B2
(45) Date of Patent: Jun. 2, 2020

(54) COMPRESSOR HAVING AN ENERGY SAVING APPARATUS, AND METHOD FOR RELIEVING THE COMPRESSOR

(71) Applicant: KNORR-BREMSE Systeme fuer Nutzfahrzeuge GmbH, Munich (DE)

(72) Inventors: Frederic Amiot, Saint-Cyr-du-Ronceray (FR); Jean-Baptiste Marescot, Manerbe (FR); Joerg Mellar, Pliening (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 16/153,871

(22) Filed: Oct. 8, 2018

(65) Prior Publication Data

US 2019/0040855 A1 Feb. 7, 2019

Related U.S. Application Data

(63) Continuation of application No. PCT/EP2017/058246, filed on Apr. 6, 2017.

(30) Foreign Application Priority Data

Apr. 7, 2016 (DE) ..... 10 2016 106 332

(51) Int. Cl.

| | |
|---|---|
| ***F04B 49/03*** | (2006.01) |
| ***F04B 49/16*** | (2006.01) |
| ***F04B 39/12*** | (2006.01) |
| ***F04B 39/14*** | (2006.01) |
| ***F04B 39/10*** | (2006.01) |

(Continued)

(52) U.S. Cl.

CPC ..... *F04B 49/03* (2013.01); *F04B 35/002* (2013.01); *F04B 39/08* (2013.01);

(Continued)

(58) Field of Classification Search

CPC .... F04B 35/002; F04B 39/08; F04B 39/1066; F04B 41/02; F04B 41/06; F04B 49/03;

(Continued)

(56) References Cited

U.S. PATENT DOCUMENTS

| | | | | |
|---|---|---|---|---|
| 3,972,652 A | | 8/1976 | Minnicino | |
| 4,498,848 A | | 2/1985 | Petrovsky et al. | |
| 4,685,653 A | * | 8/1987 | Kaltenthaler | F01L 3/20 251/284 |

FOREIGN PATENT DOCUMENTS

| | | |
|---|---|---|
| DE | 32 11 598 A1 | 11/1983 |
| DE | 34 46 096 A1 | 6/1986 |

(Continued)

OTHER PUBLICATIONS

International Preliminary Report on Patentability (PCT/IB/326 & PCT/IB/373) issued in PCT Application No. PCT/EP2017/058246 dated Oct. 18, 2018, including English translation of document C2 (German-language Written Opinion (PCT/ISA/237)) previously filed on Oct. 8, 2018 (10 pages).

(Continued)

*Primary Examiner* — Alexander B Comley
(74) *Attorney, Agent, or Firm* — Crowell & Moring LLP

(57) ABSTRACT

Compressor for generating compressed air for a commercial vehicle, having a housing with a piston chamber in a crankcase and a dead space which is configured at least in the cylinder head. The compressor has a valve device with a valve element which has an actuating section and a shut-off body for separating the dead space from the piston chamber, wherein the shut-off body can be lifted up from a valve seat in the direction of the piston chamber in order to open the valve device. The valve element is configured in one piece with the actuating section.

11 Claims, 7 Drawing Sheets

(51) Int. Cl.

| | |
|---|---|
| ***F04B 35/00*** | (2006.01) |
| ***F04B 39/08*** | (2006.01) |
| ***F04B 53/10*** | (2006.01) |
| ***F04B 53/22*** | (2006.01) |
| ***F04B 49/02*** | (2006.01) |

(52) U.S. Cl.
CPC ..... *F04B 39/1066* (2013.01); *F04B 39/125* (2013.01); *F04B 39/14* (2013.01); *F04B 49/16* (2013.01); *F04B 49/02* (2013.01); *F04B 53/1095* (2013.01); *F04B 53/22* (2013.01)

(58) Field of Classification Search
CPC ..... F04B 49/08; F04B 49/16; F04B 49/22; F04B 49/24; F04B 39/125; F04B 39/14; F04B 49/02
USPC ..... 417/440, 505, 569, 571
See application file for complete search history.

(56) References Cited

FOREIGN PATENT DOCUMENTS

| | | | | | |
|---|---|---|---|---|---|
| DE | 3783092-D1 | | * | 1/1993 | ..... F04B 49/16 |
| DE | 37 83 092 T2 | | | 7/1993 | |
| DE | 10 2008 005 435 | A1 | | 7/2009 | |
| EP | 0 254 524 | B1 | | 12/1992 | |
| JP | 10-9141 | A | | 1/1998 | |
| JP | H10-9141 | | * | 1/1998 | |
| JP | 2011-510223 | A | | 3/2011 | |
| WO | WO-2009092534 | A1 | * | 7/2009 | ..... F04B 39/08 |
| WO | WO 2010/049130 | A1 | | 5/2010 | |

OTHER PUBLICATIONS

International Search Report (PCT/ISA/210) issued in PCT Application No. PCT/EP2017/058246 dated Jun. 23, 2017 with English translation (seven pages).

German-language Written Opinion (PCT/ISA/237) issued in PCT Application No. PCT/EP2017/058246 dated Jun. 23, 2017 (eight pages).

German-language Office Action issued in counterpart German Application No. 10 2016 106 332.0 dated Dec. 21, 2016 (six pages).

Japanese-language Office Action issued in counterpart Japanese Application No. 2018-552764 dated Oct. 15, 2019 with English translation (12 pages).

* cited by examiner

Fig. 1
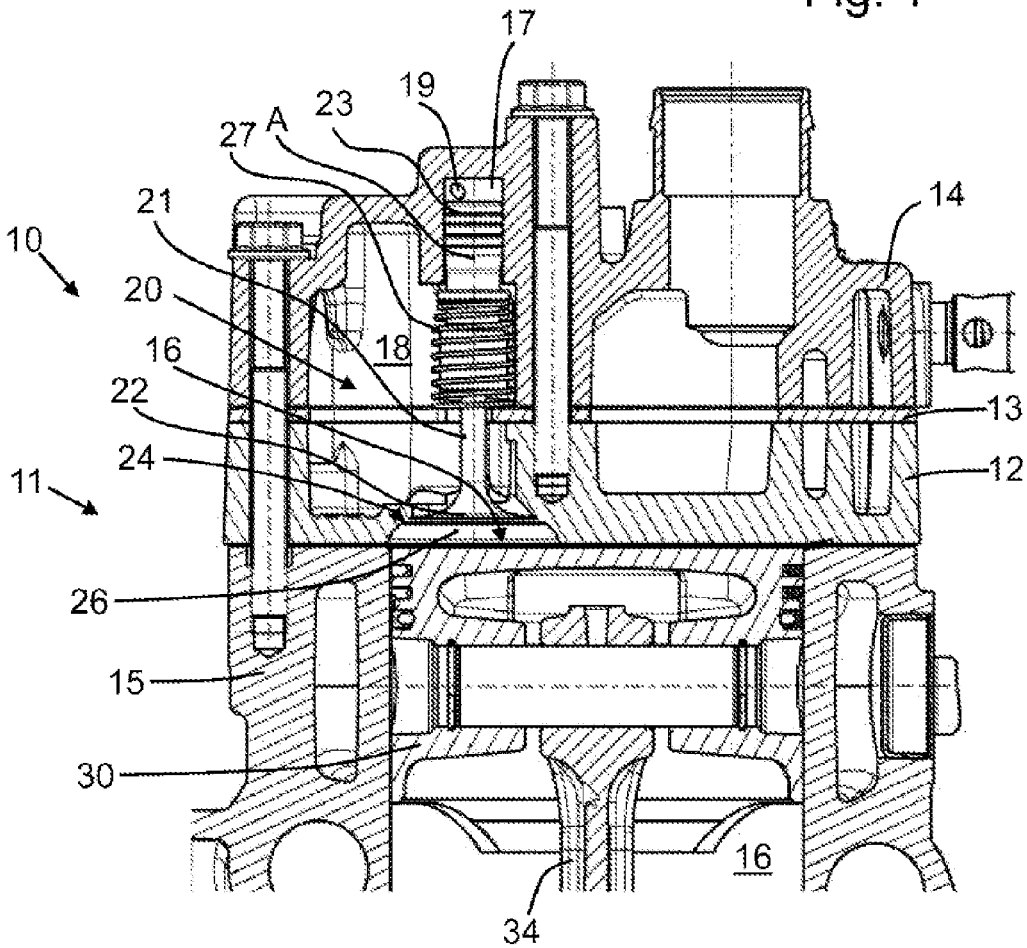
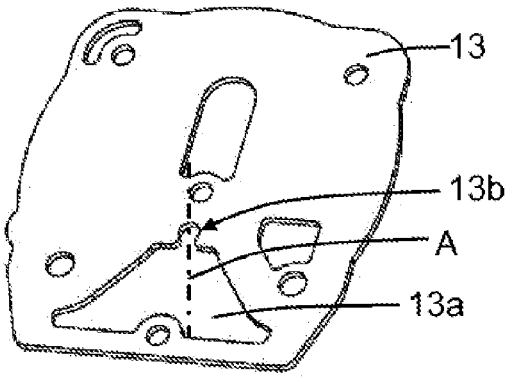
Fig. 2A
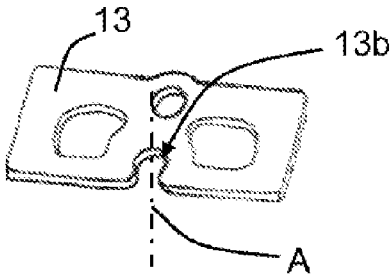
Fig. 2B

COMPRESSOR HAVING AN ENERGY SAVING APPARATUS, AND METHOD FOR RELIEVING THE COMPRESSOR

CROSS REFERENCE TO RELATED APPLICATIONS

This application is a continuation of PCT International Application No. PCT/EP2017/058246, filed Apr. 6, 2017, which claims priority under 35 U.S.C. § 119 from German Patent Application No. 10 2016 106 332.0, filed Apr. 7, 2016, the entire disclosures of which are herein expressly incorporated by reference.

BACKGROUND AND SUMMARY OF THE INVENTION

The present invention relates to a compressor for generating compressed air for a utility vehicle, and to a method for relieving a compressor of load, wherein the compressor has a housing with a piston space and with a dead space, and has a valve device for separating the dead space from the piston space.

Auxiliary assemblies of utility vehicles such as rail vehicles, heavy goods vehicles or buses are commonly operated with compressed air, which is normally delivered by a compressed-air installation operated in the vehicle. Such compressed-air installations operate using compressors, which are normally driven directly by the drive assembly of the vehicle, such as an internal combustion engine. Here, the compressor is often driven for as long as the drive assembly of the utility vehicle is in operation. In times in which there is no demand for air, or the compressed-air accumulators of the utility vehicle are completely full, the compressor can normally be relieved of load by means of an energy-saving apparatus in order to reduce the energy consumption of the compressed-air installation.

Various energy-saving apparatuses are known. Such apparatuses are commonly activated by means of a pneumatic pressure signal from an air treatment unit arranged downstream. Such apparatuses have in common the fact that, in the activated state, they permanently open the compression chamber of the compressor to a dead chamber in the cylinder head, which is designed specifically for this purpose, and/or toward the air inlet in order to reduce the thermodynamic work performed during a crank rotation.

The laid-open specification DE 10 2008 005 435 A1 has disclosed an energy-saving apparatus which has a valve element which, in order to relieve the compressor of load, is moved in the direction of the compression chamber of the compressor. The proposed design has a support plate, arranged on the valve element, for accommodating the reaction forces of a restoring spring. To permit the installation of said support plate, a two-part valve element is however necessary. Furthermore, the support plate disrupts the air flow between the piston space and the dead space and this gives rise to energy losses when the energy-saving apparatus is activated. A further disadvantage of said known energy-saving apparatus is that, for the installation of the two-part valve element, an opening in the cylinder head of the compressor is required. Said opening must be closed off and correspondingly sealed, for example by means of a closure plate, after the valve device has been installed. This is cumbersome and expensive and furthermore represents a quality risk owing to the danger of leakage.

The present invention is therefore based on the object of providing an improved compressor and an improved method for relieving a compressor for generating compressed air for a utility vehicle of load.

To achieve the object, a compressor for generating compressed air for a utility vehicle is proposed, which compressor has a housing with a piston space in a crankcase and with a dead space which is formed at least partially in a cylinder head of the compressor. The compressor furthermore has a valve device with a valve element which has an actuating section and a shut-off body for separating the dead space from the piston space, wherein, in order to open the valve device, the shut-off body can be lifted off, in the direction of the piston space, from a valve seat formed on a valve plate. The valve element is formed in one piece with the actuating section, and the valve plate is designed such that the valve element with the actuating section can be led through the valve plate in the direction of the cylinder head until the shut-off body is arranged on the valve seat and the actuating section is arranged in the cylinder head.

The housing of the compressor has a crankcase, in which there extends at least one piston space with a piston that moves therein, and a valve plate, which is arranged on the crankcase so as to close off the at least one piston space, a cylinder head, in which at least one valve element of at least one valve device is mounted, and, in some embodiments, a holding plate, which is arranged in the region between valve plate and cylinder head and through which the at least one valve element extends. A dead space extends at least partially in the region of the cylinder head.

The at least one valve element has an actuating section arranged in the cylinder head and has a shut-off body arranged in the valve plate, which shut-off body serves for separating the dead space from the piston space. In the closed state of the valve device, in particular during the generation of compressed air, the shut-off body is seated on a valve seat arranged in the valve plate, from which valve seat the shut-off body can be lifted off by means of an axial movement of the valve element in the direction of the piston space in order to permit an inflow of the air into the dead space. By means of the volume of the piston space that is increased in this way, a compression of the air is substantially avoided, whereby the thermodynamic work of the compressor is greatly reduced. The compressor is thus relieved of load, and the power output falls.

The valve element according to the invention has an actuating section which is formed in one piece therewith and which has an action device to which energy can be applied in order to effect a movement of the valve element along the longitudinal axis thereof. The valve element is thus movable axially in the direction of the piston space by means of the action device of the actuating section. An additional actuating element known from the prior art, which is installed in particular through an opening of the cylinder head and, within the cylinder head, in particular fixedly on the valve element, can thus be omitted. In the context of the invention, a valve element is considered to be in one piece if, already prior to the installation on the compressor, it forms a fixed unit which is not separated for the purposes of the installation of the valve element. Such a valve element has an action device which is formed in one piece with the valve element and which serves for the actuation of the valve device. Thus, for example for manufacturing reasons or even in the case of different materials being used, it may be necessary for the valve element to be constructed from two or more components which are fixedly connected to one another in particular in cohesive or non-positively locking form and which form a unit which is present already prior to the installation of the valve element into the compressor, such that the valve element is installed as "one part" in the compressor. Here, the valve element may form a unit composed, for example, of components which are welded, brazed, pressed or screwed together or fixedly connected to one another in some other way, such that it is considered to be a one-piece valve element within the meaning of the invention described here.

The valve plate, and a holding plate which is provided in some embodiments, of the compressor are designed such that the valve element, during the installation thereof, can be led in the direction of the cylinder head, in particular through or into openings or apertures arranged in each case in the valve plate and/or possibly in the holding plate, in order to bring the valve element into its functional position, that is to say until the shut-off body of the valve element is arranged on the valve seat and the actuating section is arranged in the cylinder head. In this functional position, the valve element extends through the valve plate and, if provided, through the holding plate, in particular perpendicular to the direction of the maximum extent of valve plate and/or holding plate.

In the case of a holding plate being used, this may be designed as a so-called intermediate plate which is arranged between valve plate and cylinder head and which extends over a part of or over the entire cross section of the compressor in that region. In this case, the holding plate is designed to be suitable for sealing off a leak of the compressor. In another embodiment, the holding plate may also be arranged for example in a suitable aperture in particular between valve plate and cylinder head of the compressor, or arranged in some other way in the region between valve plate and cylinder head in order, in particular, to accommodate the valve element and possibly to provide further suitable devices for the function of the valve device.

The described configuration of the compressor, in particular of the valve element, of the valve plate and possibly of the holding plate, permits a single-piece design of the valve element without the need for an installation opening in the cylinder head for the installation of components of a multi-part valve element in particular after the mounting of the cylinder head, whereby closure and sealing of such an installation opening after the installation of the valve element are eliminated. Likewise, in the case of the proposed configuration, the risk of leakage of the seal is eliminated.

In one embodiment of the compressor, the valve element is mounted in a valve space in the cylinder head so as to be movable along the axis of the valve element, wherein the valve space is delimited on the side averted from the piston space by the cylinder head. Since, during the installation of the cylinder head, the valve element passes into the valve space from the side facing toward the piston space, an installation opening, in particular on the side averted from the piston space, in the cylinder head of the compressor can be omitted. The cumbersome closure of the installation opening is thus eliminated, along with the associated danger of leakage.

In an alternative configuration, the compressor is designed such that the valve space is delimited on the side averted from the piston space by an intermediate plate arranged in the cylinder head. It is also the case in such a configuration that an installation opening, on the side averted from the piston space, in the cylinder head, which installation opening must in particular be sealed off in cumbersome fashion, can be omitted, whereby in this case, too, cumbersome closure of the installation opening is eliminated, along with the associated danger of leakage.

In one configuration of the compressor, a holding plate is arranged in the region between valve plate and cylinder head, through which holding plate the valve element extends after it has been installed. To permit this, the holding plate has a holding plate recess, the cross section of which corresponds at least to the cross section of the valve element in a region between the shut-off body and the actuating section. Here, the holding plate recess is formed so as to be laterally open such that the valve element can be received in the holding plate recess by being introduced laterally. By virtue of the fact that the cross section of the holding plate recess is in particular slightly larger than the cross section of the valve element in the region that is received in the holding plate recess, the holding plate can serve as a bearing element for a valve closing device arranged in the region of the valve element, in particular arranged in the region around the valve element, or arranged in the region of the cross section of the valve element on the holding plate.

To allow the valve element together with actuating section to be inserted and led through the valve plate and, if present, also through or to the holding plate, it is expedient if, in the holding plate or adjacent thereto, there is provided an opening or a clearance, the cross section of which is at least as large as a possibly suitable cross section of the actuating element in the region of its greatest extent, such that the actuating element is movable in a manner suitable for its installation in the cylinder head. One possibility for the installation of the valve element is for said valve element to be led, inclined in relation to the subsequent functional position and with the fastening section first and offset in relation to the holding plate recess, through the valve plate into the cylinder head and for the valve element to be tilted into the functional position as soon as the shut-off body reaches the valve seat. During the tilting of the valve element, the valve element then passes into the holding plate recess. In this embodiment, it is advantageous that the valve element together with actuating section can be led into the cylinder head by means of one installation process. After the mounting of the cylinder head, the valve element together with actuating section is then mounted, so as to be movable in the longitudinal direction and thus already in the functional direction, in the cylinder head.

In one embodiment of the compressor, on the valve element, there is arranged a valve closing device by means of which, in order to close the valve device, the shut-off body is movable to the valve seat counter to the direction to the piston space. Here, the valve closing device may be supported on the valve plate or on a holding plate provided for this purpose. For example, such valve closing devices involve at least a suitable spring such as for example one or more spiral springs, which are designed in particular as pressure springs, plate springs or other suitable devices.

On the valve element, the valve closing device is supported directly for example on at least one projection formed thereon, on which projection the valve closing device can be arranged, or to which projection the valve closing device can be fastened, by means of suitable devices during the installation on the valve element. It is likewise possible for the valve closing device to be supported on at least one additional holding element, such as for example on a securing disk which is connected to the valve element after the arrangement of the valve closing device, or on other suitable securing elements, which can be arranged, in particular in positively locking fashion, in particular retroactively for example on a projection, in a groove, in a bore or the like of the valve element.

In an embodiment of the holding plate in which the valve element can be led with its actuating section through a holding plate opening or adjacent to the holding plate recess, the holding plate recess is formed in the holding plate such that, after the installation on the valve element, a valve closing device can be supported on an adequately large region of the holding plate. In particular, here, configurations are expedient in which the valve element with the actuating element, which normally has a greater diameter than that region of the valve element which moves in the region of the holding plate in the installed state and during the operation of the compressor, is led through the valve plate in a region which is arranged somewhat offset from the later operating location of the valve element. Here, the valve element is moved into the operating position only when sections of relatively large diameter, such as in particular the actuating section, have already passed the holding plate. In this way, adequate support of the valve closing device, which is installed on the valve element after the valve element has been led through valve plate and holding plate, on the holding plate can be achieved. An additional support plate known from the prior art and arranged directly on the valve plate, which support plate supports the valve closing device in the direction of the piston space, is not necessary in the case of the proposed configuration.

In a further development, the valve closing device is a spring, in particular a spiral spring, which has for example a conical design. In the case of this design, the spring has, in the support region on the valve plate or holding plate, a greater diameter than at the support on the valve element, whereby a larger support area on the valve plate or holding plate is possible. On the other hand, said spring may be designed such that it sufficiently closely surrounds the valve element adjacent to a projection which is integrally formed or retroactively installed on said valve element.

In one embodiment, the smallest diameter of a spring of conical design is smaller than the diameter of that section of the valve element against which the spring is supported and over which the spring is to be led during the installation process. In the case of such a configuration of spring and valve element, it is possible, during the installation process, for use to be made of suitable installation devices by means of which those windings of the spring which have a diameter smaller than the diameter of that section of the valve element against which the spring is supported after the installation process are expanded and guided over said section. Such configurations of spring and valve element make it possible for a valve closing device designed in the form of a spring to be installed on a valve element of one-piece design.

In one further development, the shut-off body of the valve element can be lifted off from the valve seat in the direction of the piston space by direct application of pneumatic, electromagnetic or mechanical energy to the action device of the actuating section of the valve element. Here, the actuating section—and the corresponding valve space in the cylinder head and possibly further additionally required devices—is designed such that an application of suitable energy to the action device leads to an actuation of the valve element in the direction of the piston space in order to open the valve device. Thus, for example in the case of pneumatic energy being used, the valve space is formed as a piston space into which compressed air can flow for the purposes of actuating the valve element. The actuating section of the valve element has in this case the form of a pneumatic piston, which is designed to impart sealing in particular with respect to the valve space in the cylinder head and which, when compressed air is applied to the valve space, moves correspondingly axially in the direction of the piston space owing to the pneumatic energy. Here, a connection between piston space and dead space is produced, and the compressor is consequently relieved of load.

In the case of electromagnetic energy being used, it is for example the case that a suitable electromagnet is arranged at the valve space, by means of which electromagnet a magnetic field can be induced in the valve space, which magnetic field exerts an axial force on a conductor arranged therein. The actuating section of the valve element is in this case mounted in the valve space and has a conductor as action device. An application of an electromagnetic field to the action device of the actuating section leads to an axial movement of the actuating section and thus of the valve element, whereby the valve device can be opened and thus a connection between piston space and dead space can be produced. The action device as an element of the actuating section may, in this embodiment, be produced from a different material than the further sections of the valve device. Since it is however true in this case, too, that the valve element forms a unit which is present already before the installation on the compressor, such a valve element is also, as already stated above, considered to be in one piece in the context of the invention described here.

In another embodiment, the actuating section has, as an action device, a form by means of which mechanical energy can be transmitted to the actuating section in the direction of the actuation axis by means of positively locking action. Here, the actuating section in the cylinder head may be in contact with a device which transmits mechanical energy to the action device of the actuating section in order to move the shut-off body of the valve element from the valve seat in the direction of the piston space. In a further embodiment, the actuating section has, as an action device, a projection in the form of a shoulder via which mechanical energy can be transmitted to the actuating section by means of positively locking action. In another embodiment, the actuating section has a spindle groove as an action device. In this embodiment, mechanical energy can be transmitted to the valve element in the direction of the actuation axis by means of a drive element connected to a spindle drive. Since it is also the case in these structural forms that the valve element is formed in one piece with the actuating element, such a valve element is also considered to be in one piece in the context of the invention described here.

In one further development, in the open state of the valve element, the shut-off body does not extend beyond the valve plate into the piston space. Thus, the top dead center of the piston in the piston space can be provided in the direct vicinity of the valve plate. In this way, a high level of compression power is possible without there being a risk of the piston colliding with the shut-off body which necessitates an aperture for the shut-off body to protrude into when the compressor is relieved of load.

In another further development, the compressor has at least one further valve device with at least one further valve element and at least one further piston space. Here, depending on the power demand and embodiment, use may be made not only of single-cylinder compressors but also compressors with two or more cylinders, wherein in each case one further valve device with at least one further valve element and at least one further dead space may be provided for the purposes of relieving the compressor of load.

In a further embodiment, the piston space and the at least one further piston space are connected to one another via at least one dead space when the valve device and the at least one further valve device are open. By means of the connection of the piston space to a further piston space via the dead space, a build-up of pressure during a phase in which the compressor is relieved of load is substantially prevented, because the air can be pumped back and forth between the piston space and the further piston space. Alternatively, a further dead space may be provided which is connectable by means of the further valve device to the further piston space. A further dead space makes it possible for the piston spaces to be relieved of load independently of one another. In particular, it is possible for one or more dead spaces to be provided which are coupled via the intake line of the compressor to the atmosphere. By means of the coupling to the atmosphere, it is possible to realize a further lowering of the peak pressures that arise during operation with load relief, whereby the energy consumption of the compressor can be further reduced.

The invention also relates to a utility vehicle having a compressor according to the invention.

The invention furthermore relates to a method for relieving a compressor for generating compressed air for a utility vehicle of load, having a compressor which has a housing with a piston space in a crankcase and which has a dead space which is formed at least partially in a cylinder head. The compressor furthermore has a valve device with a valve element which is formed in one piece with an actuating section and with a shut-off body for separating the dead space from the piston space, wherein, in order to open the valve device, the shut-off body can be lifted off, in the direction of the piston space, from a valve seat formed in particular on a valve plate. The method has the method step of opening the valve device, when the compressor is in operation, by direct application of pneumatic, electromagnetic or mechanical energy to the actuating section of the valve element, in order to relieve the compressor of load.

The elements of the compressor described with the method will be understood within the meaning of the description above. The method can be carried out by means of an apparatus of the above-described type and the refinements described above.

An advantage of the described method is that, by means of the opening of the valve device, the air that has flowed into the piston space can at least partially flow into at least one dead space during the compression phase of the piston, whereby the compression of the air in the piston space is reduced, and said air can flow back into the compression space again during the intake phase of the piston, whereby thermodynamic work can be recovered. In this way, the compressor is relieved of load, and the energy consumption thereof is reduced. By virtue of the fact that the valve element is formed in one piece with the actuating element, there is no need for an in particular additional actuating element to be installed through an opening of the cylinder head on the valve element.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 1 shows a sectional view through an exemplary compressor according to the invention.

FIG. 2A and FIG. 2B show in each case a three-dimensional view of two exemplary holding plates according to the invention.

DETAILED DESCRIPTION OF THE DRAWINGS

Figure 3A:
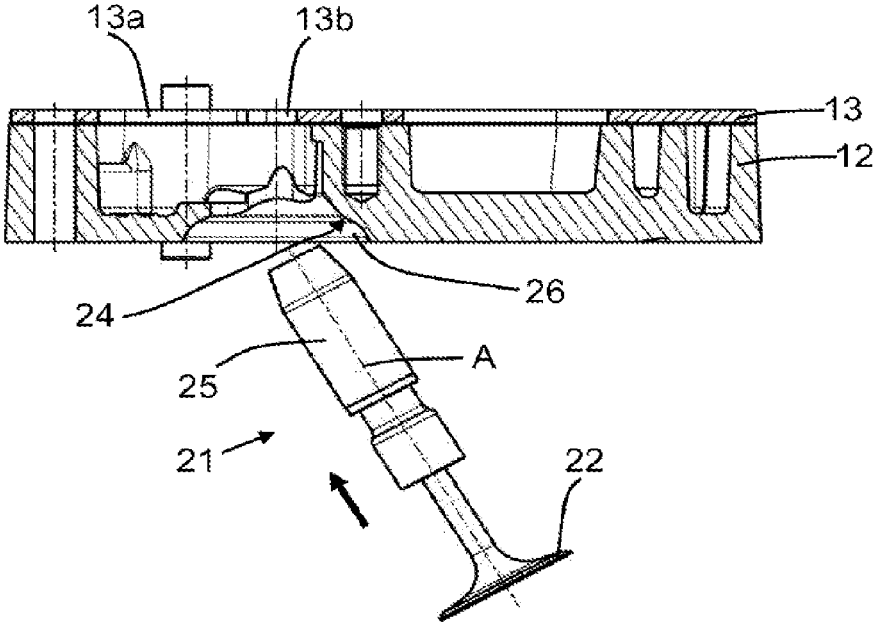
FIGS. 3A to 3D show a sequence of an exemplary installation process according to the invention of a valve element on valve plate and holding plate.
Figure 3B:
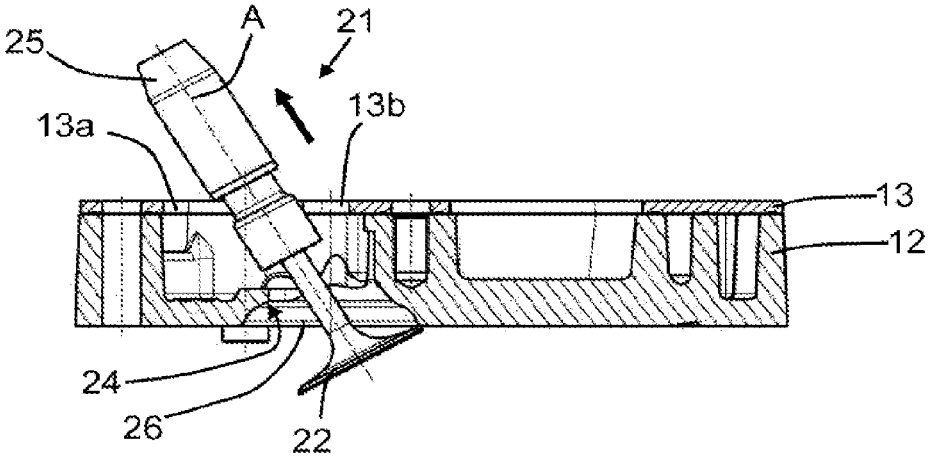

FIG. 1 shows a sectional view through an exemplary compressor 10 according to the invention. Said compressor has a housing 11 with a piston space 16 in a crankcase 15, in which there is arranged a piston 30 which is movable in the piston space 16 and which is driven by a crankshaft (not illustrated) via a connecting rod 34. The housing 11 furthermore has a valve plate 12, a holding plate 13 formed as an intermediate plate, and a cylinder head 14. A dead space 18 extends in the holding plate 13, in the valve plate 12 and in the cylinder head 14.

The compressor 10 furthermore has a valve device 20 with a valve element 21, which extends through the holding plate 13 and which is formed in one piece with a shut-off body 22 and with an actuating section 23. The actuating section 23 is in this case formed so as to mount the valve element 21 in the cylinder head in axially movable fashion. The valve device furthermore has a valve seat 24 which is formed in a recess 26, connected to the piston space 16, of the valve plate 12. In the illustration shown, the piston 30 of the compressor 10 is situated exactly at the top dead center in the piston space 16, at which said piston almost bears against the valve plate 12.

The valve element 21 is mounted, so as to be movable along the axis A of the valve element 21, in a valve space 17 formed in the cylinder head 14. The valve space 17 is in this case delimited, on the side averted from the piston space 16, by the cylinder head 14, without having an installation opening or the like. On this side, the valve space 17 of the exemplary embodiment has a feed opening 19 for compressed air. The actuating section 23 of the exemplary embodiment shown in FIG. 1 has the form of a pneumatic piston, and is designed to impart a sealing action with respect to the wall of the valve space 17. For the actuation of the valve device 20, compressed air is fed to the valve space 17 through the feed opening 19. By means of the pneumatic energy, the valve element 21 is directly actuated and is moved along its axis A, counter to the restoring force of the spring 27 which is supported on the holding plate 13, in the direction of the piston space 16, whereby the shut-off body 22 lifts off from the valve seat 24. In this way, for the purposes of relieving the compressor of load, a connection between the dead space 18 and the piston space 16 can be opened up, through which connection the air can flow from the piston space 16 into the dead space 18.

FIG. 2A shows a three-dimensional view of an exemplary holding plate 13 according to the invention. The holding plate has a holding plate opening 13*a* through which the dead space 18 extends in the installed state in the compressor 10 of the embodiment of FIG. 1. Furthermore, the holding plate opening 13*a* is designed such that, during the installation process, the valve element 21 together with actuating section 23 can be led through the holding plate 13. Furthermore, the holding plate opening 13*a* is designed such that, in the region around the valve element 21 situated in the operating position after the installation process (indicated in this case by the axis A), there is a sufficient support area available for the spring 27. In the exemplary embodiment, this is achieved in that, during the installation process, the valve element 21 with the actuating section 23 is led in an inclined manner through the region of the holding plate opening 13*a* with large opening cross section. In the subsequent operating position, which in FIG. 1 is vertical, the valve element 21 extends through the holding plate in a region in which said holding plate has a small diameter. Said section with small diameter is, in the operating position, situated in a recess 13*b* at the edge of the holding plate opening 13*a*, such that the spring 27 lies on the holding plate 13 in a large region around the valve element 21.

FIG. 2B shows a three-dimensional view of a further exemplary holding plate 13 according to the invention. The holding plate 13 has only a small extent in relation to the holding plate 13 from FIG. 2A, and is arranged in a recess between the valve plate 12 and the cylinder head 14. The holding plate 13 is designed so as not to have a holding plate opening 13*a* through which the valve element 21 would be led during the installation process. The holding plate 13 has a holding plate recess 13*b* which is designed such that a sufficient support area for the spring 27 is present in the region around the valve element 21 situated in the operating position after the installation process (likewise indicated here by the axis A). In the exemplary embodiment, this is achieved in that, during the installation process, the valve element 21 is led with the actuating section 23 in an inclined manner past the holding plate 13. In the subsequent operating position, the valve element 21 extends through the holding plate recess 13*b*. A spring 27 arranged by way of example around the valve element 21 thus lies on the holding plate 13 in a large region around the valve element 21.

FIGS. 3A to 3D show a sequence of an exemplary installation process of an exemplary valve element 21 according to the invention on the valve plate 12 and on the holding plate 13, which is formed in the manner of an intermediate plate. The actuating section 23 of the valve element 21 is protected by an installation cap 25 during this installation process. During the installation process, the valve element 21 is led, with the actuating section 23 first and in an inclined manner relative to the subsequent operating position, through the recess 26 in the valve plate 12 to the holding plate opening 13*a* (FIG. 3A). Subsequently, the upper region of the valve element is led through the valve plate 12 and through the holding plate opening 13*a* (FIG. 3B) until the actuating section 23, or that section of the valve element 21 which has a larger diameter than that region of the valve element 21 which extends through the holding plate 13 in the operating position, has passed through the holding plate opening 13*a* and the shut-off body 22 is situated in the recess 26 in the valve plate 12. Aside from the actuating region 23 itself, the valve element 21 may also have other regions of enlarged diameter, depending on the nature of the actuation and mounting of the valve element 21. The valve element 21 is subsequently placed into its operating position, in which the shut-off body 22 bears against the valve seat 24.

Figure 3C:
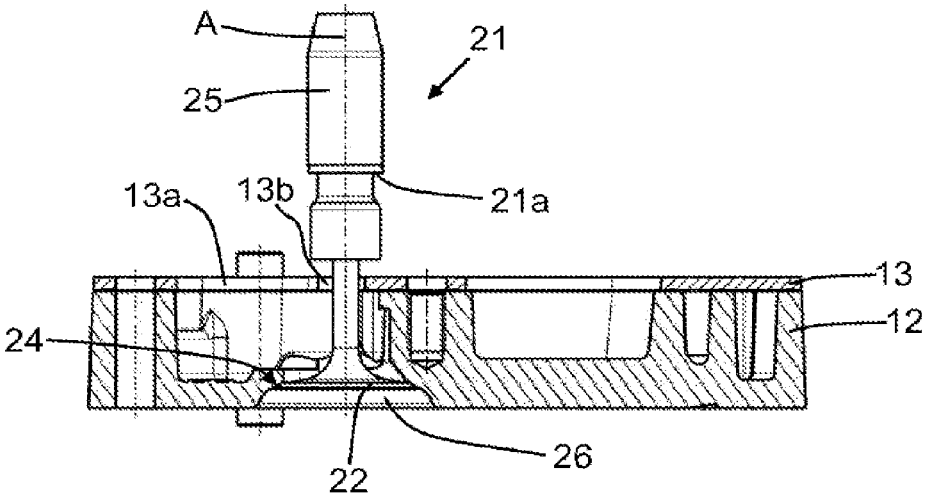
Figure 3D:
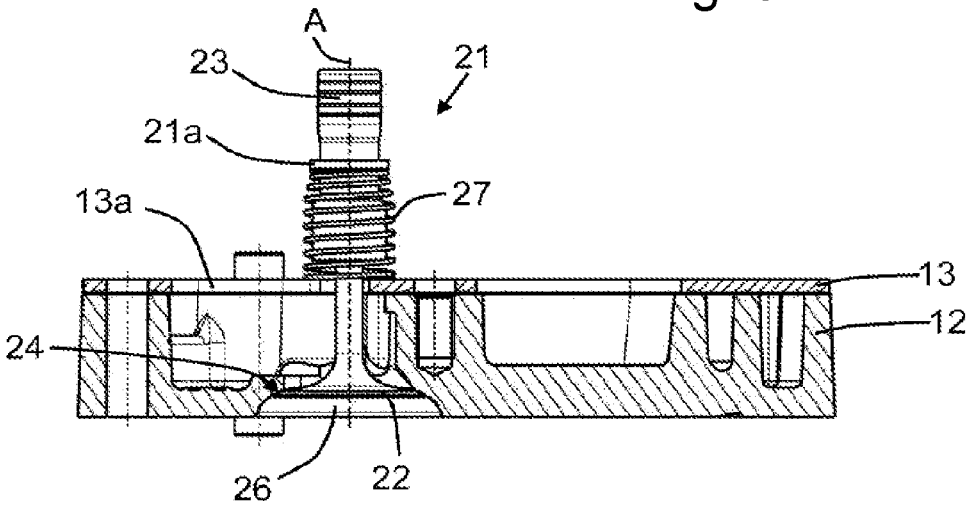

In FIG. 3C, the valve element 21 is situated in the operating position, in which it extends in the valve plate 12 and in the holding plate 13 and the shut-off element 22 bears against the valve seat 24. In FIG. 3D, the valve element is situated in the same position as in FIG. 3C, but here, the spring 27 is already mounted between a shoulder 21*a* on the valve element 21 and the holding plate 13. As can be clearly seen, in the case of the valve element 21, the installation cap 25 that protects the actuating section 23 during the installation process has been removed from the fastening section 23.

Figure 4A:
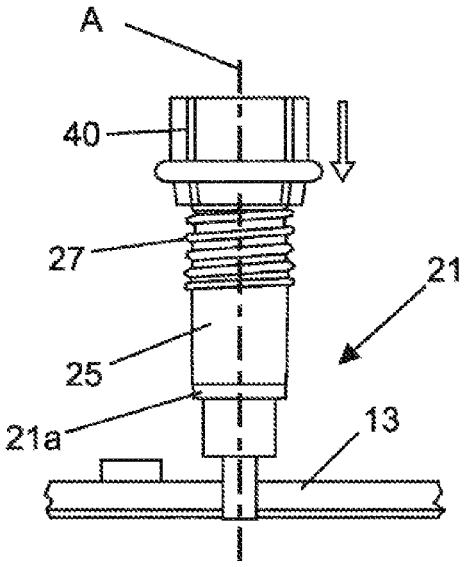
FIGS. 4A to 4C show a sequence of an exemplary installation process according to the invention of a spring on the valve element.
Figure 4B:
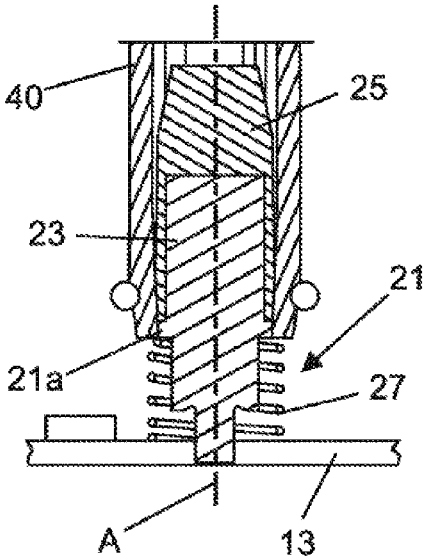
Figure 4C:
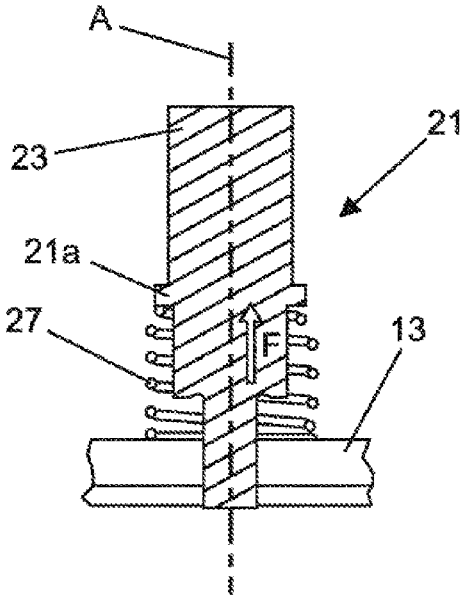

FIGS. 4A to 4C show a sequence of an exemplary installation process of a spring 27 on the valve element 21 in its operating position. The installation cap 25, which is already arranged on the actuating section 23 during the leadthrough, illustrated in FIGS. 3A to 3C, of the valve element 21 through the valve plate 12 and the holding plate 13, bears at its lower end against the shoulder 21*a* on the valve element 21 and, in said region, has at least the same outer diameter as the shoulder 21*a*. In the upper region, the installation cap 25 has a conical section, on which, in the illustration in FIG. 4A, the spring 27 which is likewise of conical form is seated.

As shown in FIG. 4A, an installation tool 40 can be fitted onto the installation cap 25, by means of which installation tool the spring is pushed onto the installation cap 25 by means of axial pressure. In particular, the diameter of the windings of the spring 27, which is originally smaller than the outer diameter of the shoulder 21*a*, is expanded as the spring is pushed onto the installation cap 25.

FIG. 4B illustrates the completion of the installation situation, in which the spring 27 has already been pushed over the installation cap 25 and the shoulder 21*a* of the valve element 21 with the aid of the installation tool 40. As is also shown in FIG. 4C, the upper windings of the spring 27, after crossing the installation cap 25, reassume their original relatively small diameter, and can thus be supported on the shoulder 21*a* on the valve element 21. The lower windings of the spring 27 are supported on the holding plate 13, such that, owing to longitudinal compression of the spring between the shoulder 21*a* and the holding plate 13, an axial force F acts on the valve element 21. In this way, the shoulder 21*a* is acted on in a direction away from the holding plate 13, and the shut-off body 22 is held on the valve seat 24.

Figure 4D:
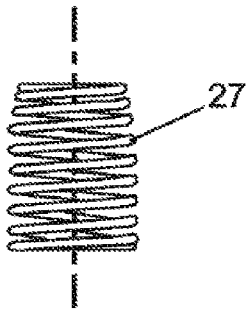
FIG. 4D shows an illustration of the exemplary spring according to the invention from FIGS. 4A to 4C.

FIG. 4D shows an illustration of the exemplary spring 27 according to the invention from FIGS. 4A to 4C. It can be clearly seen that the spring is of conical form. The upper windings, which after the installation process are supported on the shoulder 21*a*, consequently have a smaller diameter than the lower windings, which after the installation process are supported on the holding plate 13. Since the recess 13*b* at the edge of the holding plate opening 13*a* is open only in a region required for the lateral insertion of the valve element 21 (FIGS. 2A and 2B), the spring 27 can, in the exemplary embodiment, be supported on an adequately large area of the holding plate 13.

Figure 5:
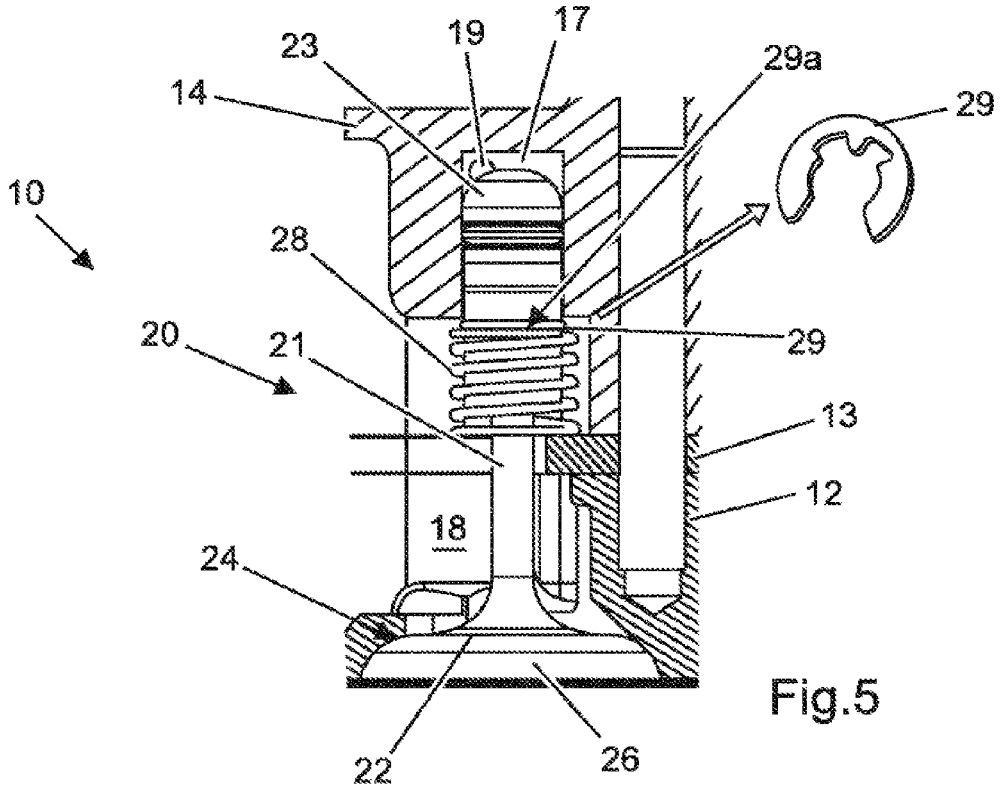
FIG. 5 shows a further exemplary valve device according to the invention with different spring and securing device on the valve element.

FIG. 5 shows a further exemplary valve device 20 according to the invention with a spring 28 of cylindrical form and with a securing disk 29 which is fastened to the valve element 21. The valve device 20 shown in FIG. 5 differs from the valve device 20 shown in the preceding figures substantially by the fact that, on the valve element 21, instead of the shoulder 21*a*, there is formed a groove 29*a* for receiving a securing disk. In this exemplary embodiment, after the valve element 21 has been led through the holding plate opening 13*a* or into the holding plate recess 13*b*, a cylindrical spring 29, the inner diameter of which is larger than the outer diameter of the actuating section 23 of the valve element 21, is led over the valve element 21, and said spring is supported on the valve element 21 by means of the securing disc 29 inserted into the groove 29*a*.

Figure 6:
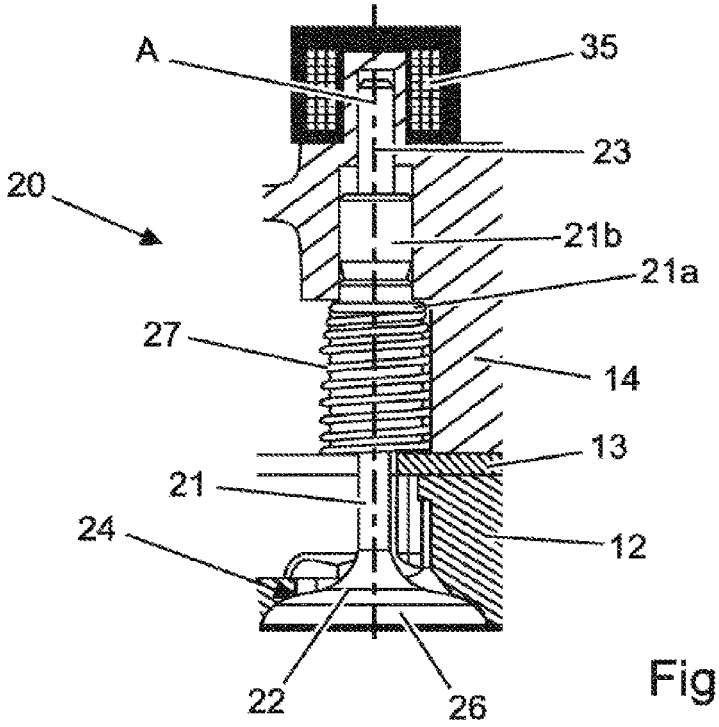
FIG. 6 shows a further exemplary valve device according to the invention, which is actuated by means of electromagnetic energy.

FIG. 6 shows a further exemplary valve device 20 according to the invention, which is actuatable by means of electromagnetic energy. Here, the valve element 21 has an actuating section 23 with magnetically conductive action device, which is mounted in the region of an electromagnet 35 arranged on the cylinder head 24 and which is movable in the direction of the axis A of the valve element 21 by application of electromagnetic energy. In the embodiment illustrated, the valve device 20 is opened by exertion of load on the actuating section 23 of the valve element 21, and is closed, in the absence of electromagnetic energy, by the restoring force of the spring 27. The valve element 21 from FIG. 6 has not only the actuating section 23 but also a bearing section 21*b*, by means of which the valve element 21 is mounted in the valve space 17 in the cylinder head 14.

Figure 7:
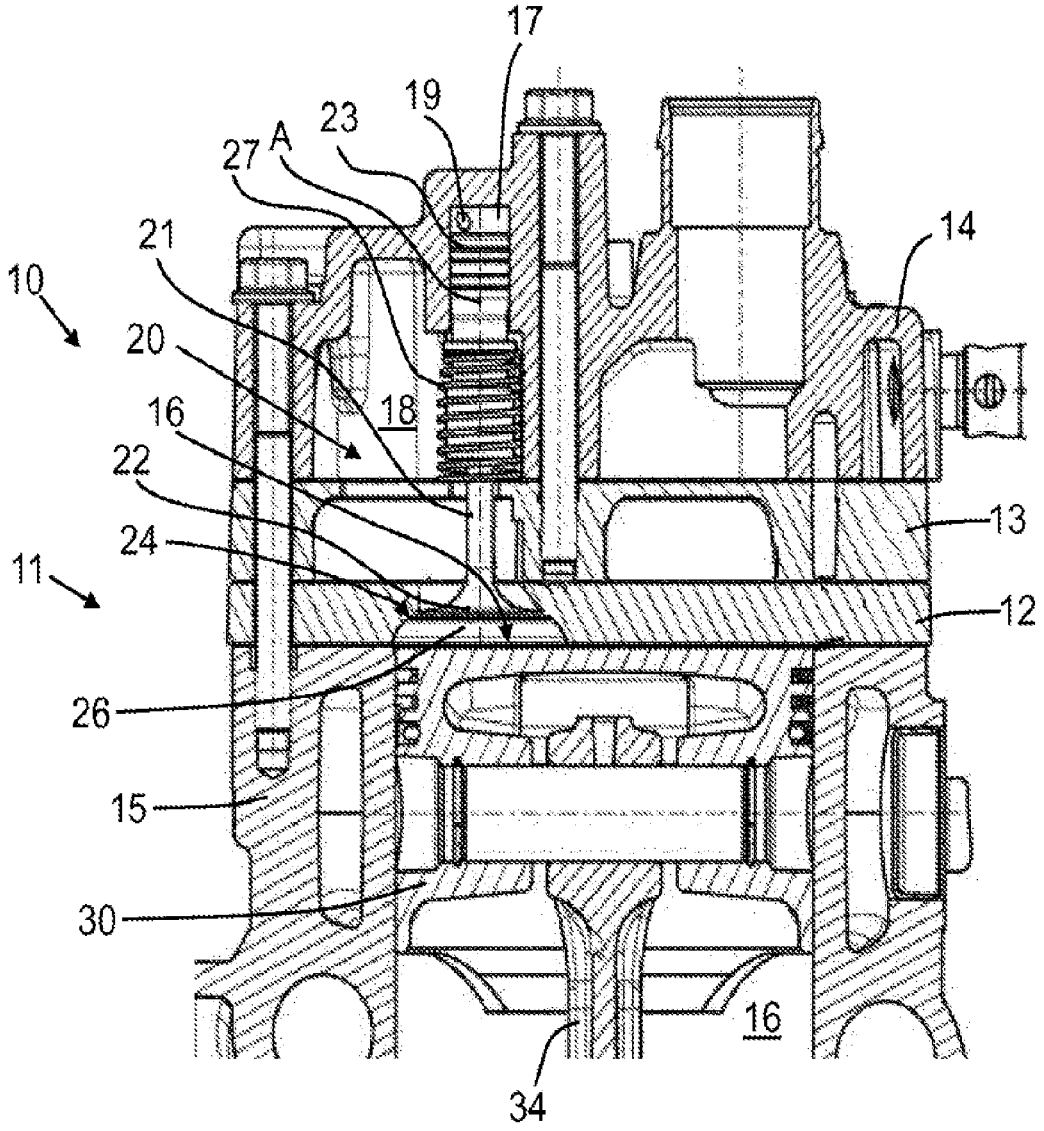
FIG. 7 shows a sectional view through a further exemplary compressor according to the invention.

FIG. 7 shows a sectional view through a further exemplary compressor 10 according to the invention. The compressor 10 shown in FIG. 7 differs from the compressor 10 shown in FIG. 1 by the fact that the valve plate 12 is of planar design, such that the dead space 18 does not extend into the valve plate 12. This embodiment of the compressor 10 has a so-called supercooling plate as intermediate plate, which also serves as holding plate 13. The dead space 18 is in this embodiment formed in the holding plate 13 and in the cylinder head 14. The design of the holding plate opening 13*a* with holding plate recess 13*b* corresponds, in the exemplary embodiment shown in FIG. 7, substantially to the design of the holding plate opening 13*a* with holding plate recess 13*b* from FIG. 2A.

Figure 8:
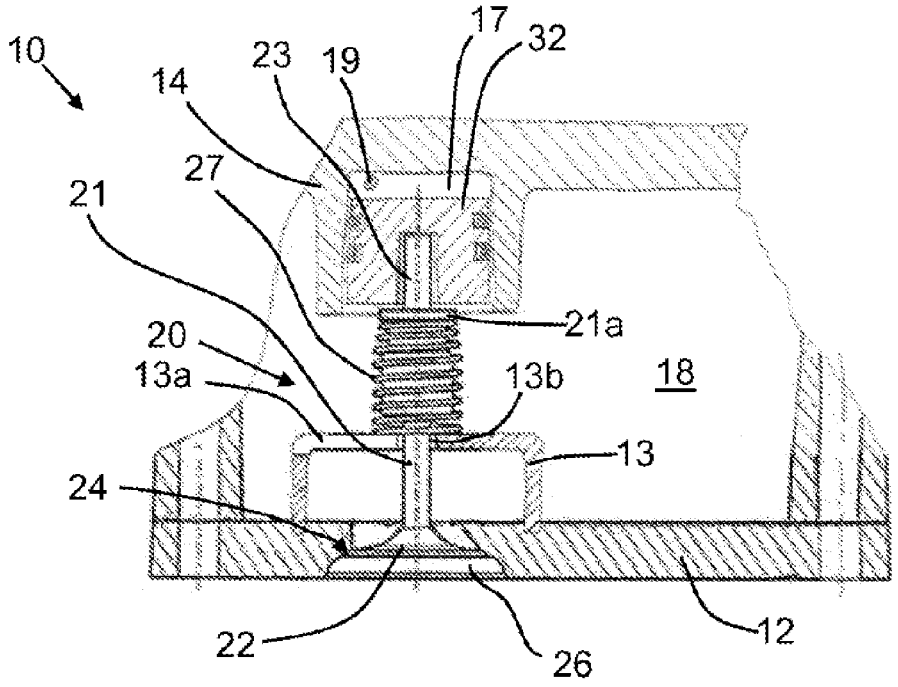
FIG. 8 shows a sectional view of a detail of a further exemplary compressor according to the invention.

FIG. 8 shows a sectional view of a detail of a further exemplary compressor 10 according to the invention. The holding plate 13 of this compressor 10 has a U shape and is arranged in apertures in a planar valve plate 12. Analogously to the embodiments of FIGS. 1 to 7, the valve element 21 is led, in an inclined manner in relation to the subsequent functional position (illustrated in FIG. 8), through the valve plate 12 and the holding plate opening 13*a* of the holding plate 13, and is then tilted into the illustrated functional position, wherein the valve element 21 passes into the holding plate recess 13*b*. After the insertion of the valve element 21 into the valve plate 12, the spring 27 is installed on the valve element 21 as shown in FIGS. 4A to 4C. Subsequently, the cylinder head 14 is installed on the compressor, wherein the actuating section 23 of the valve element 21 is led into an actuating element 32. The actuating element 32 is mounted in the valve space 17 of the cylinder head 12 and is designed such that the actuating section 23 of the valve element can be received and mounted in centered fashion therein. Here, the actuating element 32 may lie loosely on the actuating section 23 (as illustrated in FIG. 8) and transmit mechanical energy to the valve element 21 by means of positively locking action with the valve end or the shoulder 21*a* on the valve element 21 as action device. It is likewise possible for the valve element to be inserted with screw action into a thread formed in the actuating element 31, wherein a corresponding external thread as action device is then provided on the actuating section 23 of the valve element 21. By applying compressed air to the valve space 17, the actuating element 32 is accelerated in the direction of the piston space 16, whereby the actuating section 23 of the valve element 21 has mechanical energy applied thereto. In this way, the valve element 21 is actuated, and is lifted off from the valve seat 24 owing to the shut-off body 22. In the embodiment shown, an increase of the actuating force is possible owing to the enlarged surface of the actuating element 32.

Figure 9:
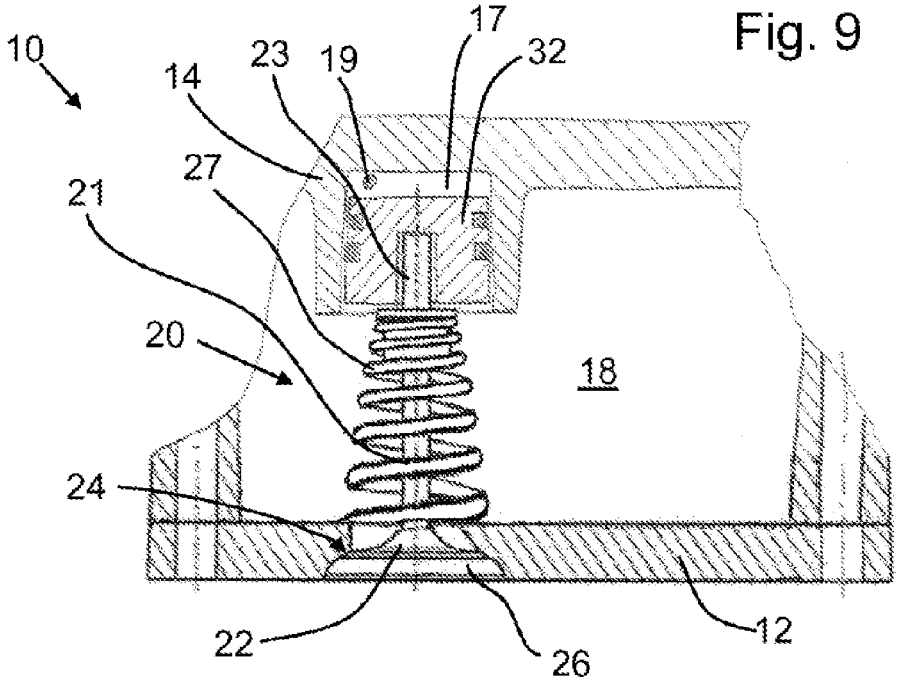
FIG. 9 shows a sectional view of a detail of a further exemplary compressor according to the invention.

FIG. 9 shows a sectional view of a detail of a further exemplary compressor 10 according to the invention. The compressor 10 from FIG. 9 differs from the compressor 10 from FIG. 8 merely in that no holding plate 13 is provided therein. In this exemplary embodiment, the spring 27 is supported directly on the valve plate 12.

All of the embodiments illustrated have in common the fact that the cylinder head 14 is installed on the valve element or on the holding plate 13 or the valve plate 12 after the installation of the springs 27, 28. Here, the valve element 21 is led along its axis A with the actuating section 23, and possibly with a bearing section 21*b*, into the valve space 17 formed in the cylinder head 14. Since the valve device 20 is installed already before the cylinder head 14 is mounted, there is no need for an installation opening on the cylinder head 14 via which the valve device 20 is accessible from the outside. The valve space 17 can thus be formed so as to be delimited by the cylinder head on the side averted from the piston space 16, that is to say on the outer side of the cylinder head 14.

LIST OF REFERENCE DESIGNATIONS

10 Compressor
11 Housing
12 Valve plate
13 Holding plate
13*a* Holding plate opening
13*b* Recess at the edge of the holding plate opening
14 Cylinder head
15 Crankcase
16 Piston space
17 Valve space
18 Dead space
19 Feed opening
20 Valve device
21 Valve element
21*a* Shoulder on the valve element
21*b* Bearing section
22 Shut-off body
23 Actuating section
24 Valve seat
25 Installation cap
26 Recess in the valve plate
27 Spring
28 Spring
29 Securing disk
29*a* Groove on the valve element
30 Piston
32 Actuating element
34 Connecting rod
35 Electromagnet
40 Installation tool The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A compressor for generating compressed air for a utility vehicle, comprising:

a housing with a piston space in a crankcase and with a dead space which is formed at least partially in a cylinder head of the compressor; and a valve device with a valve element which has an actuating section and a shut-off body for separating the dead space from the piston space, wherein, in order to open the valve device, the shut-off body is liftable off, in a direction of the piston space, from a valve seat formed on a valve plate, wherein the valve element is formed in one piece with the actuating section, and the valve plate is configured such that the valve element with the actuating section is leadable through said valve plate in a direction of the cylinder head until the shut-off body is arranged on the valve seat and the actuating section is arranged in the cylinder head;

in a region between the valve plate and the cylinder head, a holding plate is arranged which has a holding plate recess with a cross section which corresponds at least to a cross section of the valve element in a region between the shut-off body and the actuating section, and which is formed so as to be laterally open such that the valve element, as it is led in a direction of the cylinder head, is received by the holding plate recess by being introduced laterally, such that the valve element then, in the region between shut-off body and actuating section, extends through the holding plate.

2. The compressor as claimed in claim 1, wherein the valve element is mounted in a valve space of the cylinder head so as to be movable along an axis of the valve element, and the valve space is delimited on a side averted from the piston space by the cylinder head.

3. The compressor as claimed in claim 1, wherein the valve element is mounted in a valve space of the cylinder head so as to be movable along an axis of the valve element, and the valve space is delimited on a side averted from the piston space by the holding plate.

4. The compressor as claimed in claim 1, wherein on the valve element, a valve closing device is arranged by which, in order to close the valve device, the shut-off body is movable to the valve seat counter to the direction to the piston space, and the valve closing device is supported on the holding plate or on the valve plate.

5. The compressor as claimed in claim 4, wherein the valve closing device is, on a side situated opposite the holding plate and/or the valve plate, supported on the valve element.

6. The compressor as claimed in claim 5, wherein the valve closing device is a spring which has a conical design, and a smallest diameter of the spring is smaller than a diameter of a section of the valve element against which the spring is supported and over which the spring is leadable during an installation process.

7. The compressor as claimed in claim 4, wherein the valve closing device is a spring which has a conical design, and a smallest diameter of the spring is smaller than a diameter of a section of the valve element against which the spring is supported and over which the spring is leadable during an installation process.

8. The compressor as claimed in claim 1, wherein the shut-off body is liftable off from the valve seat in a direction of the piston space by direct application of pneumatic, electromagnetic or mechanical energy to the actuating section of the valve element.

9. The compressor as claimed in claim 1, wherein the compressor has at least one further valve device with at least one further valve element and/or has at least one further piston space.

10. The compressor as claimed in claim 9, wherein the compressor includes at least one further piston space and the piston space and the at least one further piston space are connected to one another via at least one dead space when the valve device and the at least one further valve device are open.

11. A method for relieving a load of a compressor used for generating compressed air for a utility vehicle, wherein the compressor comprises:

a housing with a piston space in a crankcase and with a dead space which is formed at least partially in a cylinder head, and a valve device with a valve element which has an actuating section and a shut-off body for separating the dead space from the piston space, wherein, in order to open the valve device, the shut-off body is liftable off, in a direction of the piston space, from a valve seat formed on a valve plate, wherein the valve element is formed in one piece with the actuating section, and the valve plate is configured such that the valve element with the actuating section is leadable through said valve plate in a direction of the cylinder head until the shut-off body is arranged on the valve seat and the actuating section is arranged in the cylinder head; and in a region between the valve plate and the cylinder head, a holding plate is arranged which has a holding plate recess with a cross section which corresponds at least to a cross section of the valve element in a region between the shut-off body and the actuating section, and which is formed so as to be laterally open such that the valve element, as it is led in a direction of the cylinder head, is received by the holding plate recess by being introduced laterally, such that the valve element then, in the region between shut-off body and actuating section, extends through the holding plate;

the method comprising the acts of:

directly applying pneumatic, electromagnetic or mechanical energy to the actuating section of the valve element; and opening the valve device, via the direct application, in order to relieve the compressor of load.

* * * * *